United States Patent [19]

van der Smissen et al.

[11] Patent Number: 4,591,399

[45] Date of Patent: May 27, 1986

[54] IGNITING MIXTURE FOR CHEMICAL OXYGEN GENERATORS

[75] Inventors: Carl E. van der Smissen, Lubeck; Rainer Ernst, Curau, both of Fed. Rep. of Germany

[73] Assignee: Drägerwerk AG, Fed. Rep. of Germany

[21] Appl. No.: 752,234

[22] Filed: Jul. 2, 1985

[30] Foreign Application Priority Data

Jul. 4, 1984 [DE] Fed. Rep. of Germany ..... 3424502

[51] Int. Cl.[4] ..... C06B 45/00

[52] U.S. Cl. ..... 149/2; 149/108.6; 252/186.1; 252/186.21; 252/186.22; 252/186.43

[58] Field of Search ..... 252/186.1, 186.21, 186.22, 252/186.43; 149/2, 108.6; 423/581, 582, 583

[56] References Cited

U.S. PATENT DOCUMENTS 3,861,880 1/1975 Thompson ..... 102/530

3,868,225 2/1975 Tidd ..... 102/286

3,986,838 10/1976 Reichert ..... 102/530

*Primary Examiner*—Stephen J. Lechert, Jr.

*Attorney, Agent, or Firm*—McGlew and Tuttle

[57] ABSTRACT

An igniting mixture is provided for chemical oxygen generators used in respirators and resuscitators for making an oxygen supply available. In chemical oxygen generators the oxygen is present in chemically bound form and when needed is released in the course of a chemical reaction with the triggering of an ignition. The ignition device with an igniting mixture is normally contained in the upper part of the chemical oxygen supply present in candle form. From here, then, begins the reaction after the ignition. To ensure the storability of the oxygen generators, the igniting mixture remains thermally stable up to a temperature of 100° C., but can be activated by water and also by a higher temperature. The igniting composition consists of a mixture of an alkali and metal oxygen compound selectively with an oxygen containing silicon compound, percarbonate, metal peroxide or superoxide.

10 Claims, No Drawings

IGNITING MIXTURE FOR CHEMICAL OXYGEN GENERATORS

FIELD AND BACKGROUND OF THE INVENTION

The present invention relates to an igniting mixture for chemical oxygen generators containing an alkali metal oxygen compound.

Chemical oxygen generators are used in respirators and resuscitatores to provide an oxygen supply. In chemical oxygen generators the oxygen is present in chemically bound form and, when needed, is released in the course of a chemical reaction with the triggering of an ignition. Usually the igniting composition is contained in the form of an igniting device in the upper part of the chemical oxygen supply which is present in candle form. From here, then, the reaction begins in close contact therewith, after the ignition.

From German patent No. 22 19 080, an igniting mixture in conical form is known which consists of salts of iodine containing inorganic acids and inorganic oxidants. It contains as iodine compound made of at least one compound from the group of the alkali metal and alkaline earth metal iodides and oxyiodides. As main oxidant, at least one alkali metal monoxide is used and, if the iodine compound is an iodide, additionally an auxiliary oxidant is used. The auxiliary oxidant consists of at least one compound of the group of the alkali metal and alkaline earth metal oxides, chlorates and perchlorates. To the extent that metal peroxides or superoxides are used, the use occurs only in a small percentage and for the purpose of suppressing the formation of free halogen. This igniting is suitable for the igniting of chemical oxygen generators and can be triggered by addition of water. Alternatively also the ignition can be carried out through an electric incandescent wire or by means of pyrotechnic initiation. During burnoff, an odorless, non-toxic gas evolves, so that use on oxygen generators for breathing purposes is possible.

Unfortunately the thermal activation of this igniting mixture sets in already under 100° C. This property makes oxygen generators equipped therewith unsuitable for storage under elevated temperature.

Besides, it is unsuitable for use as an ignition transmitter which is needed inside oxygen generators of the type shown in German patent No. 30 39 442 which, to avoid the danger of rupture, are composed of individual oxygen candles. There, between pairs of oxygen candles, an ignition transmitter is inserted, which after burnoff of the preceding candle transmits the reaction to the following candle. Here the igniting mixture of the ignition transmitter would, even before it is reached by the reaction front, be triggered already by the hot oxygen formed in an uncontrolled manner.

SUMMARY OF THE INVENTION

It is the object of the invention to improve the igniting mixture for oxygen generators in such a way that it remains thermally stable up to a temperature of 100° C., but is activatable by water and also by a higher temperature which may be briefly present.

This problem is solved by using igniting mixtures for chemical oxygen generators, which each contain an alkali metal oxygen compound, and by the fact that the alkali metal oxygen compound with an activator containing active oxygen or silicon, both ground and mixed is pressed under moderate pressure into a cone. With a mixed proportion of alkali metal oxygen compounds the following advantageous igniting mixtures were found, with which the problem is solved both with respect to the long-term temperature stability of at least 100° C., regarding the activation by water, as well as brief exposure to a higher temperature.

They can be used also very favorably in ignition devices and glow charges in chemical oxygen generators with a chemical substance lodged in the interior of a closed vessel with a unilateral outlet, generating oxygen by chemical reaction, in which the chemical composition is divided into single candles. The latter are then fitted together axially in modular construction and joined in contact with one another via the glow charges. The igniting device, which is to be ignited from the outside, is located before the first oxygen candle and activates it. The reaction front then travels in the direction of the next one, which is then activated by the following glow charge.

DESCRIPTION OF THE PREFERRED EMBODIMENTS

Various preferred forms of the invention are now described. The following are examples of the invention;

(a) An igniting mixture consisted of a mixture of sodium monoxide and an oxygen containing silicon compound. As the silicon compound, silicon dioxide as quartz powder or as silica gel, alkali/alkaline earth silicates as common glass or alumosilicates as molecular sieves were used.

By adding this compound, the reaction velocity of the igniting mixture can be influenced. Peroxides such as alkali peroxides, alkaline earth peroxides, zinc peroxide and alkali superoxides act in this manner. An igniting cone consisting of these materials is produced, e.g. as follows:

Sodium monoxide, 10 g and 15 g of a molecular sieve are finely ground and mixed in a ball mill. The mixture is pressed under moderate pressure into a cone. This cone is suitable for primary ignition of an oxygen candle by a drop of water as well as for secondary ignition of an additional and then folloiwng oxygen candles by means of the heat of reaction of the bottom layer of the preceding oxygen candle.

(b) Another igniting mixture consisted of a mixture of sodium monoxide and a percarbonate. As the percarbonate, alkali and alkaline earth percarbonates are suitable. By addition of alkali, alkaline earth, or zinc peroxide or alkali superoxide the reaction velocity can be influenced. An igniting cone can here be produced, e.g. as follows:

In a ball mill, 10 g sodium monoxide and 15 g sodium percarbonate are ground and mixed. The mixture is compacted under moderate pressure into a cone. This cone is suitable for primary ignition of an oxygen candle by means of a drop of water as well as for secondary ignition of a second candle by means of the heat of reaction of the bottom layer of the first candle.

(c) The next igniting mixture consists of a mixture of sodium monoxide and a metal peroxide or superoxide.

As metal peroxides alkali, alkaline earth, and zinc peroxide, and as metal superoxides sodium and potassium superoxides are used.

An igniting cone according to the invention is produced e.g. as follows:

In a ball mill, 10 g sodium monoxide, 10 g potassium superoxide and 5 g zinc peroxide are ground and mixed.

The mixture is compacted under moderate pressure into a cone. This cone is suitable for primary ignition of an oxygen candle by means of a drop of water as well as for secondary ignition of a second oxygen candle by means of the heat of reaction of the bottom layer of the first candle.

(d) The ignition device consists of a mixture of an alkali superoxide with a percarbonate. As percarbonate, alkali and alkaline earth percarbonates enter into consideration.

By addition of an oxygen containing silicon compound the reaction velocity can be influenced.

Another igniting cone according to the invention can be produced e.g. as follows:

10 g potassium superoxide, 10 g sodium percarbonate and 5 g silica gel are ground and mixed in a ball mill. The mixture is compacted under moderate pressure into a cone. This cone is suitable for primary ignition of an oxygen candle by means of a drop of water as well as for secondary ignition of a second oxygen candle by means of the heat of reaction of the bottom layer of the first candle.

While specific embodiments of the invention have been shown and described in detail to illustrate the application of the principles of the invention, it will be understood that the invention may be embodied otherwise without departing from such principles.

What is claimed is:

1. An igniting mixture for chemical oxygen generators comprising an alkali metal oxygen compound with an activator containing one of active oxygen and silicon which are both ground and mixed together and pressed under moderate pressure into a cone, the alkali metal oxygen compound being selected from the group consisting of alkali metal monoxide, peroxide, and superoxide.

2. An igniting mixture according to claim 1, wherein sodium monoxide with an oxygen containing silicon compound comprise the mixture.

3. An igniting mixture according to claim 1 wherein 10 g sodium monoxide and 15 g of a molecular sieve are mixed to form the mixture.

4. An igniting mixture according to claim 1 wherein sodium monoxide with one of a metal peroxide constitute the mixture.

5. An igniting mixture according to claim 1 wherein 10 g sodium monoxide, 10 g potassium superoxide and 5 g zinc peroxide are mixed to form the mixture.

6. An igniting mixture according to claim 1 wherein 10 g potassium superoxide, 10 g sodium percarbonate and 5 g silica gel are mixed to form the mixture.

7. An igniting mixture for chemical oxygen generators comprising an alkali metal oxygen compound with an activator containing one of active oxygen and silicon which are both ground and mixed together and pressed under moderate pressure into a cone, wherein sodium monoxide with a percarbonate comprise the mixture.

8. An igniting mixture according to claim 7 wherein 10 g sodium monoxide and 15 g sodium percarbonate are mixed to form the mixture.

9. An igniting mixture for chemical oxygen generators comprising an alkali metal oxygen compound with an activator containing one of active oxygen and silicon which are both ground and mixed together and pressed under moderate pressure into a cone, wherein an alkali superoxide with a percarbonate constitute the mixture.

10. An ignition mixture for chemical oxygen generators consisting essentially of an alkali metal-oxygen compound with an activator containing one of active oxygen and silicon, which together are ground and mixed and pressed into a cone, said alkali metal-oxygen compound comprising sodium monoxide and said activator being selected from the group consisting of silicon dioxide, alkali/alkaline earth silicate, alumino silicate, percarbonate, and metal peroxide.

* * * * *